US007766629B2

(12) United States Patent
Seko et al.

(10) Patent No.: US 7,766,629 B2
(45) Date of Patent: Aug. 3, 2010

(54) FLUID PUMP, COOLING APPARATUS AND ELECTRICAL APPLIANCE

(75) Inventors: Katsuya Seko, Yokohama (JP); Kenichi Ito, Zama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 1017 days.

(21) Appl. No.: 11/091,930

(22) Filed: Mar. 29, 2005

(65) Prior Publication Data

US 2005/0232795 A1 Oct. 20, 2005

(30) Foreign Application Priority Data

Mar. 30, 2004 (JP) ..... 2004-099354

(51) Int. Cl.
*F04B 35/04* (2006.01)

(52) U.S. Cl. ..... 417/423.14; 417/354; 361/699

(58) Field of Classification Search ..... 417/353, 417/354, 423.1, 423.14; 361/697, 699
See application file for complete search history.

(56) References Cited

U.S. PATENT DOCUMENTS

2003/0072656 A1* 4/2003 Niwatsukino et al. ..... 417/354
2004/0018080 A1* 1/2004 Yu et al. ..... 415/55.1

FOREIGN PATENT DOCUMENTS

GB 2 220 706 A 1/2000
JP 02-294594 A 12/1990
JP 06-159283 A 6/1994
JP H06-159283 7/1994
JP 06-288380 A 10/1994
JP 2001-123978 5/2001
JP 2001-132677 5/2001

OTHER PUBLICATIONS

Chinese Office Action corresponding to Chinese Patent Application No. 2005100595817 dated Feb. 2, 2007.
Chinese Office Action dated Aug. 3, 2007 for corresponding Chinese Patent Application No. 2005100595817.
The Patent Office of the State Intellectual Property Office of the People's Republic of China (Office Action).

* cited by examiner

*Primary Examiner*—Charles G Freay
*Assistant Examiner*—Peter J Bertheaud
(74) *Attorney, Agent, or Firm*—Pillsbury Winthrop Shaw Pittman, LLP

(57) ABSTRACT

A fluid pump having a case with a pump chamber defined by axial side surfaces and a circumferential surface, a suction port and a discharge port both provided in the circumferential surface so as to communicate with the pump chamber, an impeller formed into a disc shape and rotatably mounted in the pump chamber, a pressure generating protrusion, which generates pressure by rotation of the impeller and is located inside the pump chamber at a radial position, and a motor, which drives the impeller, installed in the case and having a stator and a rotor to which the impeller is attached for rotating together.

21 Claims, 8 Drawing Sheets

FLUID PUMP, COOLING APPARATUS AND ELECTRICAL APPLIANCE

CROSS REFERENCE TO RELATED APPLICATIONS

This application is based upon and claims the benefit of priority from Japanese Patent Application No. 2004-099354, filed in Japan on Mar. 30, 2004.

BACKGROUND OF THE INVENTION

1. Field of the Invention

The present invention relates to a fluid pump including a motor for rotationally driving an impeller, a cooling apparatus including such a fluid pump, and to an electrical appliance including such a cooling apparatus.

2. Description of the Related Art

A fluid pump is known which includes a motor having a rotor to which an impeller is integrally fixed for rotation together with the rotor, so that the pump vanes of the impeller serve to suction a fluid into a pump chamber via a suction port, and to discharge the fluid out of the pump chamber via a discharge port, as disclosed in Japanese Published Unexamined Patent Application No. 2001-123978 and Japanese Published Unexamined Patent Application No. 2001-132677, for example.

It has been proposed to incorporate this type of a fluid pump in an electrical appliance such as a personal computer, for cooling a CPU, which is a heat-generating component. In this case, the configuration may be as follows. A face of the pump case is disposed in contact with the CPU, and an impeller in the fluid pump is rotated to cause a cooling fluid (liquid) to circulate inside the pump, so as to absorb heat generated by the CPU via the pump case into the fluid flowing in the pump, thus to cool the CPU.

However, an existing fluid pump has a drawback that relatively strong vibration is generated during the pump operation (during the motor rotation), accompanied with a significant noise. A reason can be described as follows, for example.

The case of the fluid pump is provided with a pressure generating protrusion located inside the pump chamber between a suction port and a discharge port, so as to confront the pump vanes of the impeller. When the motor rotates the impeller for operating the pump, the fluid pressed by the pump vanes of the impeller collides with the pressure generating protrusion, which generates considerable vibration. In addition, when the vibration due to the collision of the fluid with the pressure generating protrusion (vibration due to pressure generation) and vibration due to cogging torque of the motor rotating the impeller are generated at the same timing, the vibration may be augmented.

In particular, when such a fluid pump is employed in an electrical appliance, for example, for cooling a CPU in a personal computer, the vibration and noise are critical issues to be overcome.

SUMMARY OF THE INVENTION

Therefore, an object of the present invention is to provide a fluid pump that can minimize vibration and noise.

The present invention provides a fluid pump comprising a case defining a pump chamber; a suction port and a discharge port provided on the case so as to communicate with the pump chamber; an impeller rotatably mounted in the pump chamber and having pump vanes the impeller, when rotated, sucking a fluid into the pump chamber via the suction port and discharging the fluid out of the pump chamber via the discharge port; a pressure generating protrusion located inside the pump chamber at a position between the suction port and the discharge port, so as to confront the pump vanes; a motor for driving the impeller, installed in the case and having a stator and a rotor to which the impeller is integrally attached for rotating together; and at least a lateral portion of the pressure generating protrusion on the side of the discharge port is formed in a smooth slope or curved surface, the pressure generating protrusion protruding from an inner surface of the pump chamber and having a surface rising from the inner surface of the pump chamber, said rising surface including a part that stands in a rotational direction of the impeller and is formed so as to be inclined in the rotational direction of the impeller.

With the fluid pump thus configured, when the motor rotates the impeller to operate the pump, the fluid pressed by the pump vanes of the impeller collides with the pressure generating protrusion, thereby causing a portion of the fluid inside the pump chamber to be discharged through the discharge port. At this moment, since the lateral portion of the pressure generating protrusion on the discharge port side is formed in a smooth slope or curved surface, the impact created by the collision of the fluid with the pressure generating protrusion is mitigated. Accordingly, the vibration generated by the collision of the fluid with the pressure generating protrusion can be reduced, which also results in reduction of the noise accompanying the vibration.

For attaining such an objective, it is also effective to produce a timing gap between the pressure generation by the impeller rotation and the cogging torque generation by the motor, or a frequency gap between the pressure generation frequency of the impeller rotation and the cogging torque frequency of the motor, or further to arrange a part or the whole of the pump vanes of the impeller at irregular intervals, instead of taking the above remedies.

BRIEF DESCRIPTION OF THE DRAWINGS

Other objects, features and advantages of the present invention will become clear upon reviewing the following description of the embodiment with reference to the accompanying drawings, in which.

DETAILED DESCRIPTION OF THE INVENTION

Figure 1:
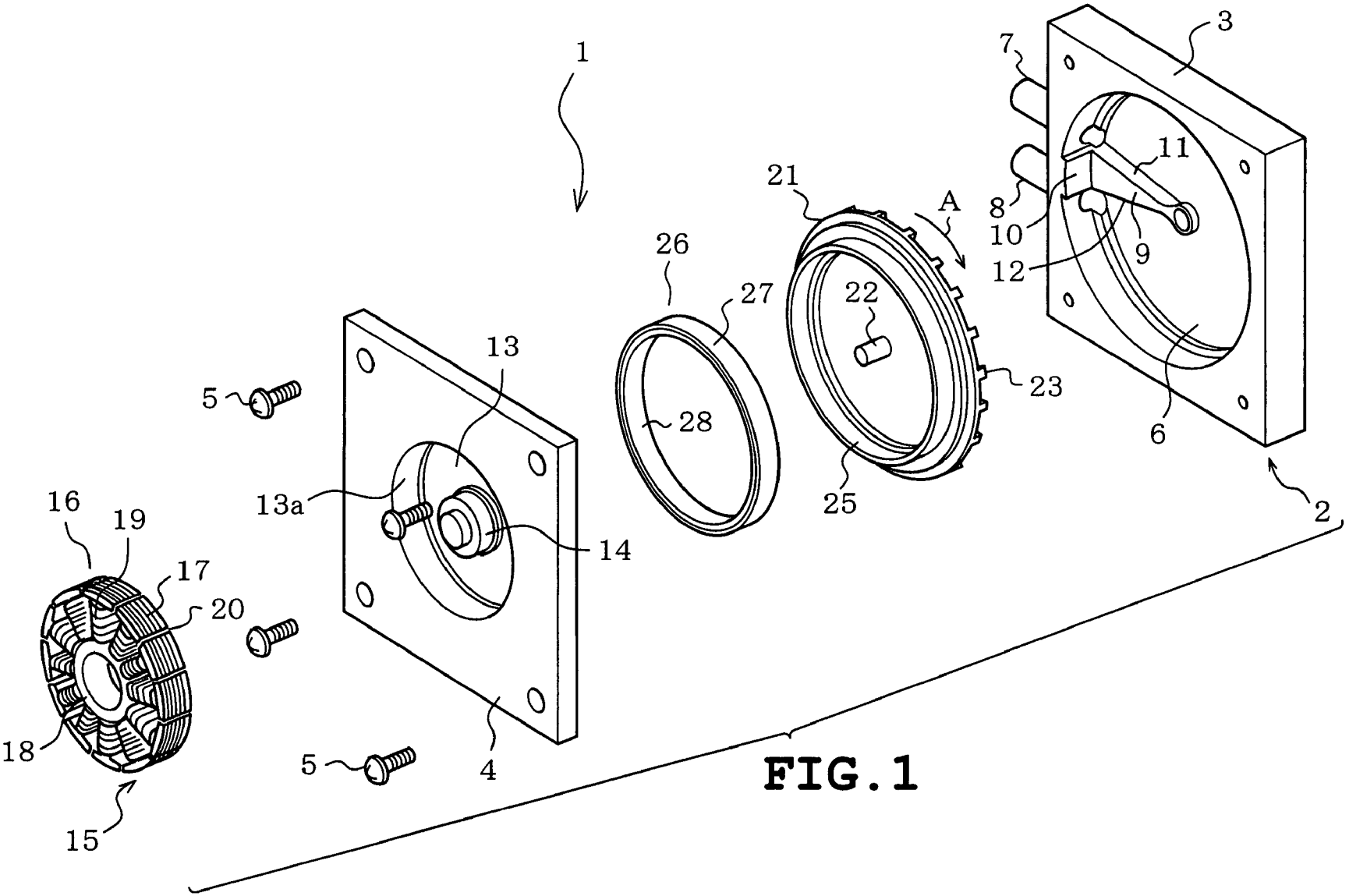
FIG. 1 is an exploded perspective view showing a fluid pump according to a first embodiment of the present invention.
Figure 2:
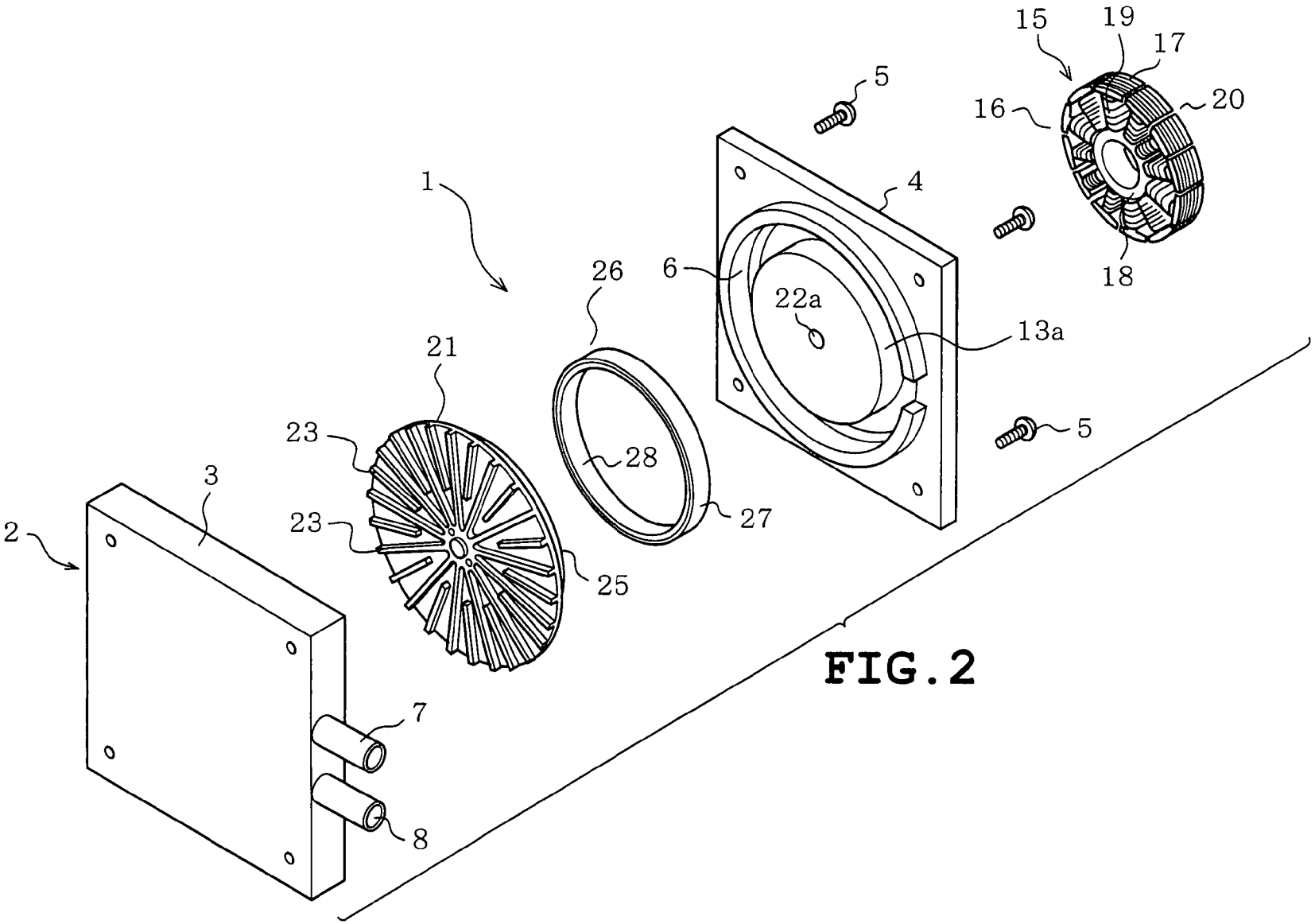
FIG. 2 is an exploded perspective view showing the fluid pump of FIG. 1 from an opposite direction (from the first case side)
Figure 3:
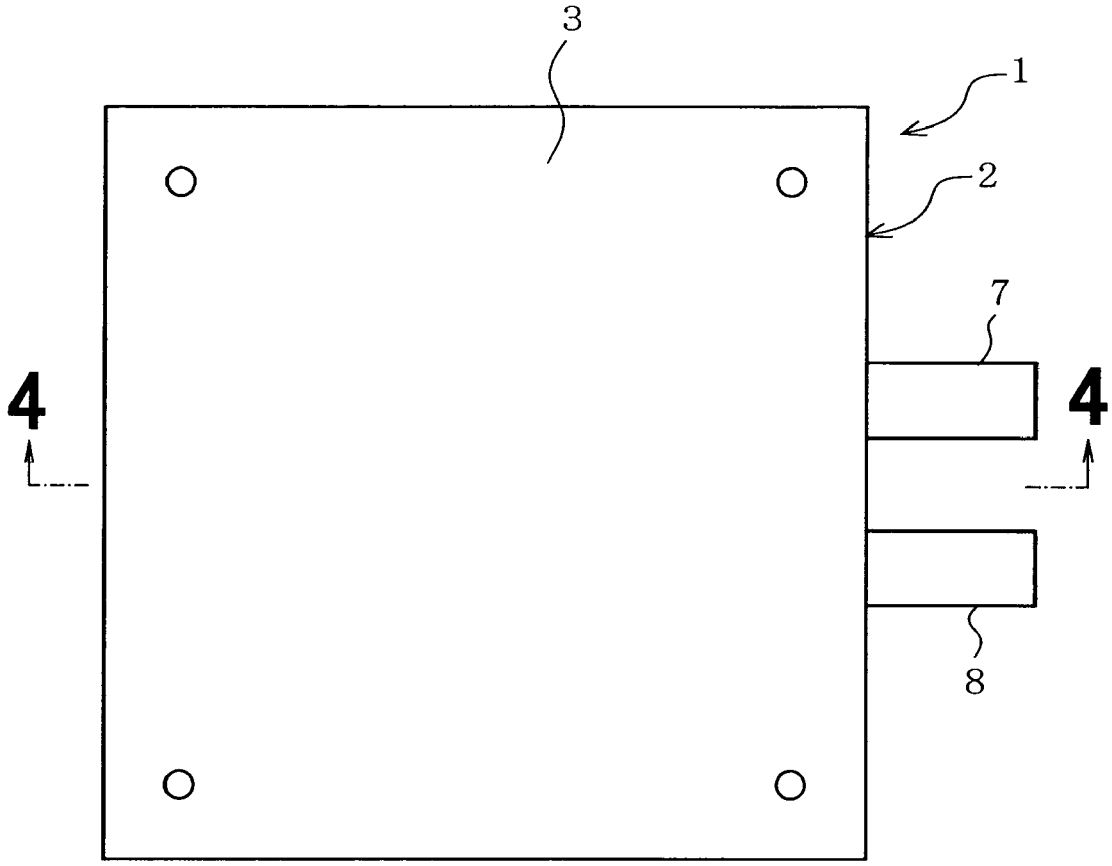
FIG. 3 is an elevational view showing the fluid pump.
Figure 4:
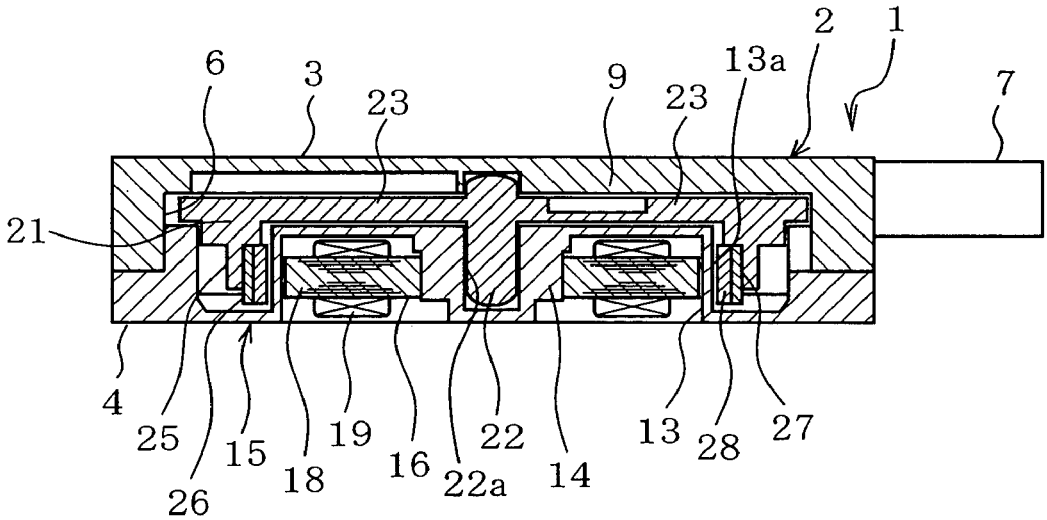
FIG. 4 is a cross-sectional view taken along the line 4-4 of FIG. 3.
Figure 5:
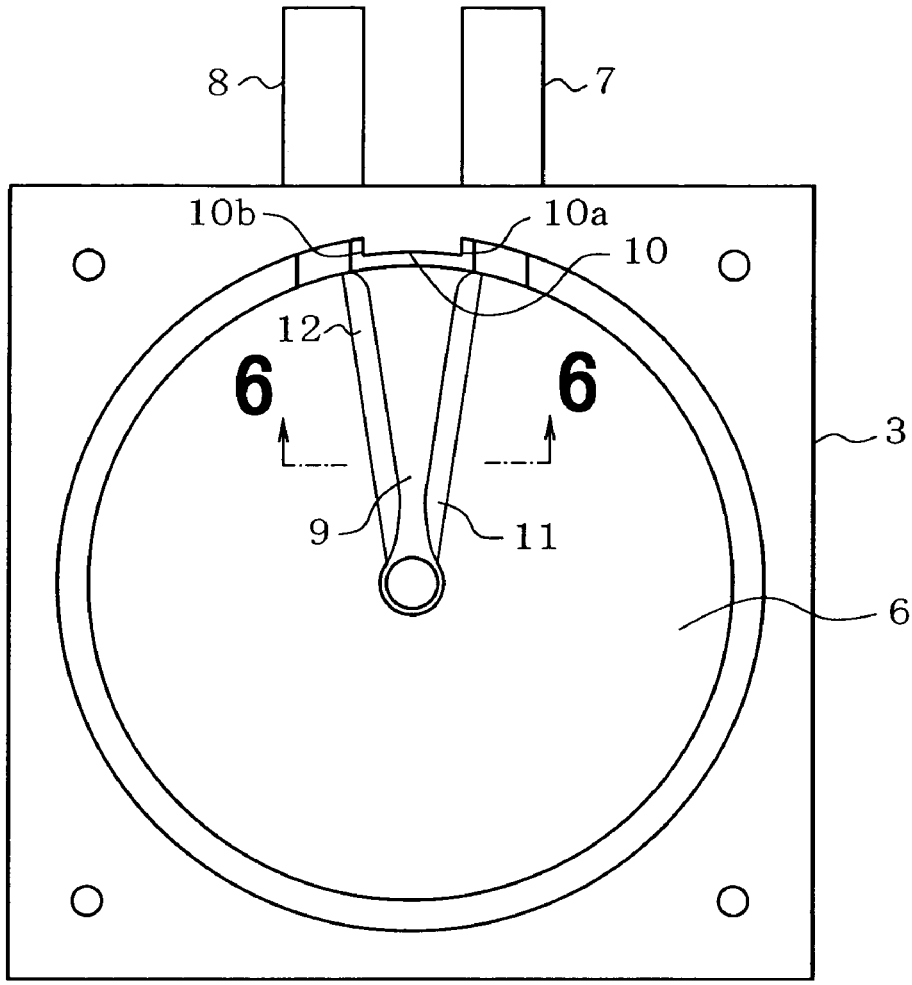
FIG. 5 is a plan view of the first case, viewed from the side of the pump chamber.

Referring to FIG. 1 through FIG. 8, a first embodiment of the present invention will be described hereunder. FIG. 3 is an elevational view showing a fluid pump 1 according to the present invention, and FIG. 4 is a cross-sectional view of the same fluid pump 1. FIG. 1 is an exploded perspective view and FIG. 2 is an exploded perspective view from an opposite direction, respectively showing the same fluid pump 1. As shown in FIGS. 1 to 4, a case 2 of the fluid pump 1 is of a generally rectangular shape, and includes a first case 3 and a second case 4 combined with a plurality of screws 5. Between the first case 3 and the second case 4, a circular pump chamber 6 is provided.

Figure 6:
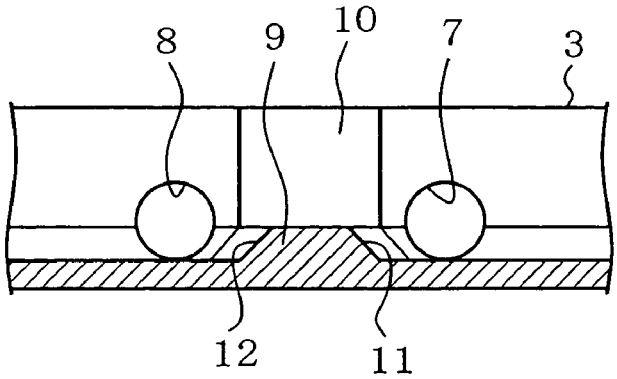
FIG. 6 is a fragmentary cross-sectional view taken along the line 6-6 of FIG. 5.

The first case 3 is provided with a cylindrically shaped suction port 7 and discharge port 8 on a lateral face thereof. The suction port 7 and discharge port 8 are laterally projecting substantially parallel to each other, and an end portion of each passage communicates with the pump chamber 6. The first case 3 is also provided with a first pressure generating protrusion 9 formed on an inner bottom face of the pump chamber 6 at a position between the suction port 7 and discharge port 8 so as to extend radially, and a second pressure generating protrusion 10 formed on an inner peripheral wall of the pump chamber 6 at a position between the suction port 7 and discharge port 8. The first pressure generating protrusion 9 is of such a shape that it expands from the central portion of the pump chamber 6 toward the suction port 7 and discharge port 8, as shown also in FIG. 5, and both lateral faces are formed in flat and smooth slopes 11 and 12 as shown in FIG. 6. In other words, according to this embodiment the first pressure generating protrusion 9 is provided with the smooth slopes 11 and 12 on both sides corresponding to the suction port 7 (the right side in FIG. 5) and discharge port 8 (the left side in FIG. 5).

Figure 7:
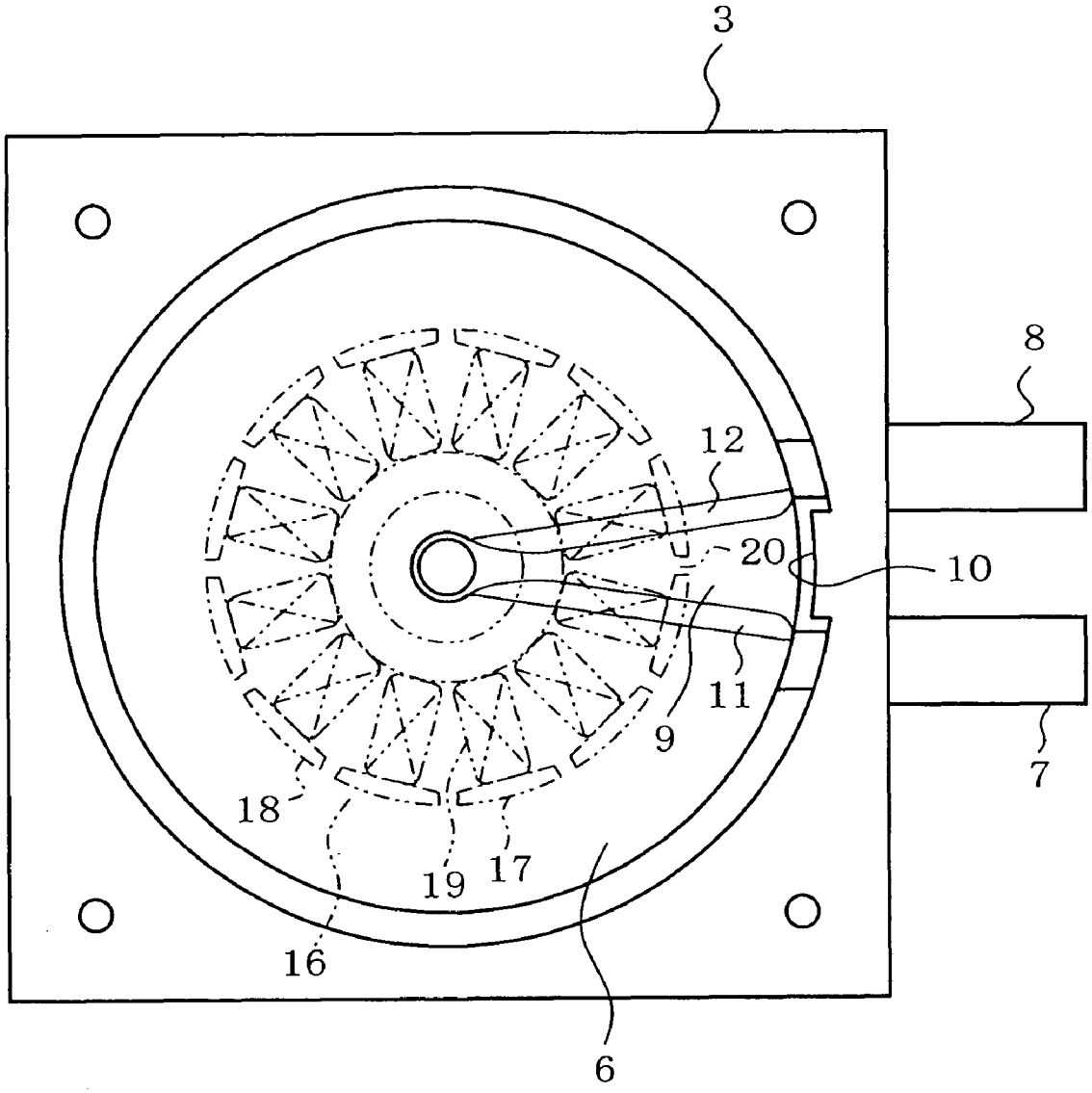
FIG. 7 is a schematic plan view showing a layout of a stator of a motor and a first pressure generating protrusion.

The second case 4 is provided with a stator housing 13, which is a circular portion recessed toward the pump chamber 6 with an opening facing the opposite side thereof (i.e. facing outside), located in a central portion of the second case 4. The stator housing 13 includes a stator mounting base 14 projecting from a central portion thereof. A stator 16 of a motor 15 is accommodated in the stator housing 13 and fixedly mounted on the stator mounting base 14. The stator 16 includes a stator core 18 having a plurality, specifically twelve pieces in this case, of teeth 17 and coils 19 wound on the respective teeth 17, as shown in FIG. 7. The teeth 17 of the stator core 18 are disposed at regular intervals, and slots (openings) 20 are defined between the tip portions of the teeth 17. Accordingly, the stator 16 has twelve slots.

It is to be noted, as shown in FIG. 7, the stator 16 is installed such that the center of one of the slots 20 is aligned with the center line of the first pressure generating protrusion 9, and hence the center of such slot 20 is shifted from the lateral slopes 11 and 12, which are the pressure generating portions of the first pressure generating protrusion 9.

In the pump chamber 6, a disc-shaped impeller 21 is rotatably installed. An axle 22 disposed at the center of the impeller 21 is rotatably supported by a bearing 22*a* located at a central portion of the stator housing 13. In the impeller 21, a multitude, specifically 26 pieces in this embodiment, of pump vanes 23 are provided so as to be radially aligned at regular intervals on a face of the impeller 21 opposing the first case 3. Accordingly, the intervals of the pump vanes 23 are constant all over the impeller. When the impeller 21 rotates, each of the pump vanes 23 confronts the first pressure generating protrusion 9, and an outer circumferential edge face of each pump vane 23 confronts the second pressure generating protrusion 10.

The impeller 21 includes a short cylindrical portion 25 on the face opposing the second case 4, and a rotor 26 of the motor 15 is disposed along an inner circumferential surface of the cylindrical portion 25. The rotor 26 includes a short cylindrical rotor yoke 27 and a short cylindrical rotor magnet 28 located along an inner circumferential surface of the rotor yoke 27. An inner circumferential surface of the rotor magnet 28 is opposing an outer periphery of the teeth 17 of the stator 16, via a peripheral wall 13*a* of the stator housing 13. The rotor magnet 28 is magnetized in 8 poles, for example.

Accordingly, the rotor 26 and the stator 16 constitute the outer-rotor type motor 15, so that when the rotor 26 rotates the impeller 21 also rotates together with the rotor 26. The opening of the stator housing 13 is closed with a cover (not shown). That is the structure of the fluid pump 1.

Figure 8:
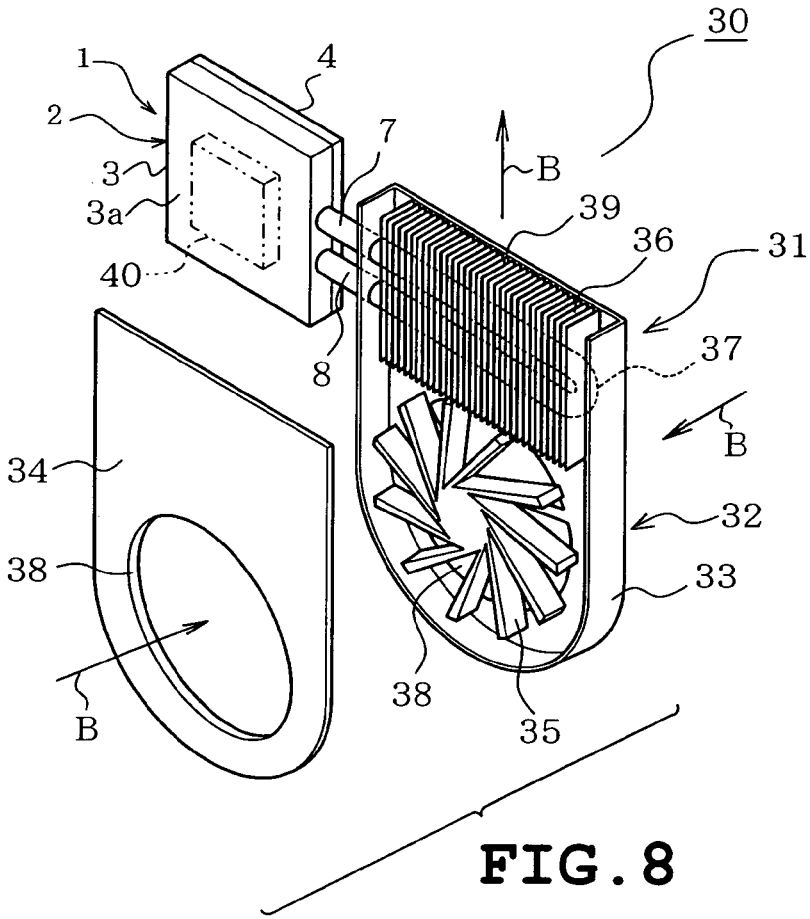
FIG. 8 is a partially exploded perspective view showing a cooling apparatus.

Now, FIG. 8 depicts a cooling apparatus 30 with which the fluid pump 1 is employed. Referring to FIG. 8, a unit case 32 of a heat-dissipating section 31 is constituted by combining a fan case 33 and a cover 34. The fan case 33 accommodates a fan 35 including a built-in fan motor (not shown), and a multitude of heat-dissipating fins 36 is located above the fan 35. The fan case 33 also includes a U-shaped fluid pipe 37 disposed through the heat-dissipating fins 36. An end portion of this fluid pipe 37 is connected to the suction port 7 of the fluid pump 1 and the other end portion is connected to the discharge port 8. In the fluid pipe 37 as well as in the pump chamber 6 of the fluid pump 1, a cooling liquid (fluid) is sealed in.

The fan case 33 and the cover 34 are respectively provided with a circular air inlet 38 at a position corresponding to the fan 35. A region above the heat-dissipating fins 36 is left open, so as to constitute an air outlet 39. A heat-generating component 40, which is the object to be cooled, is directly attached to an outer face 3*a* of the first case 3 of the fluid pump 1. Accordingly, the first case 3 serves also as a heat-receiving section to receive the heat of the heat-generating component 40.

The operation of the above configuration will now be described. Controlling a current supply to the coil 19 of the motor 15 in the fluid pump 1 causes the impeller 21 to rotate together with the rotor 26 in a direction of the arrow A in FIG. 1. Then the fluid pressed by the pump vanes 23 of the impeller 21 sequentially collides with the first and the second pressure generating protrusions 9 and 10, to be thereby discharged toward the fluid pipe 37 through the discharge port 8. On the side of the suction port 7 (the right side in FIG. 5) of the first and the second pressure generating protrusions 9 and 10, a negative pressure is generated because of the rotation of the pump vanes 23, by which the fluid in the fluid pipe 37 is suctioned into the pump chamber 6 through the suction port 7. Thus the cooling fluid inside the pump chamber 6 circulates through the fluid pipe 37. During this process, the heat generated by the heat-generating component 40 is removed via the case 2 of the fluid pump 1, by the fluid flowing inside the pump chamber 6.

Meanwhile in the heat-dissipating section 31, the fan 35 is rotated by the fan motor, which causes air around the unit case 32 to be suctioned into the unit case 32 through the air inlet 38 as indicated by the arrow B in FIG. 8, while air inside the unit case 32 is discharged outward through between the heat-dissipating fins 36 and through the air outlet 39. The fluid discharged through the discharge port 8 releases the heat via the heat-dissipating fins 36 while passing through the fluid pipe 37, and the fluid now cooled upon releasing the heat returns to the fluid pump 1 through the suction port 7. This is how the heat-generating component 40 is cooled by the cooling apparatus 30 with which the fluid pump 1 is employed.

The first embodiment provides the following advantageous effects. First, referring to the fluid pump 1, since the lateral face of the radially extending first pressure generating protrusion 9, out of the first and the second pressure generating protrusions 9 and 10, is formed in a smooth slope 12 at least on the side of the discharge port 8, the fluid propelled by the pump vanes 23 when the impeller 21 rotates can flow relatively smoothly upon colliding with the first pressure generating protrusions 9, and hence the impact is mitigated. Accordingly the vibration generated by the collision of the fluid with the first pressure generating protrusion 9 can be reduced, which also results in reduction of the noise accompanying the vibration. In this embodiment, the lateral face of the first pressure generating protrusion 9 on the side of the suction port 7 is also formed in a smooth slope 11, the fluid can also flow through this region smoothly, which further reduces the vibration, as well as the noise accompanying the vibration.

In addition, with respect to this embodiment there is a concern about a decrease in pressure as a result of forming the lateral faces of the first pressure generating protrusion 9 in smooth slopes 11 and 12, however increasing the rotating speed of the impeller 21 (rotating speed of the rotor 26) allows to secure an adequate flow rate of the fluid.

Further, according to the first embodiment, the lateral faces 10*a* and 10*b* (see FIG. 5) of the second pressure generating protrusion 10, on the respective side of the suction port 7 and discharge port 8, are formed with a sharp corner, however these faces may also be formed in a smooth slope.

The stator 16 is installed such that the center of one of the slots 20 is aligned with the center line of the first pressure generating protrusion 9, in other words shifted from the slopes 11 and 12, which are the pressure generating regions of the first pressure generating protrusion 9. Therefore, when the impeller 21 is rotated, the pressure generating timing of the first pressure generating protrusion 9 and the cogging torque generating timing of the motor 15 become different. Such arrangement allows to prevent resonance of the vibration, or even mutually suppressing the vibration, thus further reducing the vibration and noise.

Still further, the impeller 21 is provided with 26 pump vanes 23, while the rotor magnet 28 of the motor 15 has 8 magnetic poles and the stator 16 has 12 slots. Accordingly, the impeller 21 generates a pressure 26 times per rotation. On the other hand, the rotor 26 generates the cogging torque 24 times per rotation, which is the lowest common multiple of the number of magnetic poles 8 and the number of slots 12. Therefore, the number of pressure generating times per rotation (26) of the impeller 21 and the number of cogging torque generating times per rotation (24) of the motor 15 are different, and hence the frequencies thereof are also different. Consequently, such arrangement allows further reducing the vibration and noise.

Accordingly, employing the fluid pump 1 thus constructed so as to suppress vibration and noise for use with the cooling apparatus 30 as shown in FIG. 8 achieves the cooling apparatus 30 that does not generate vibration or noise.

Figure 9:
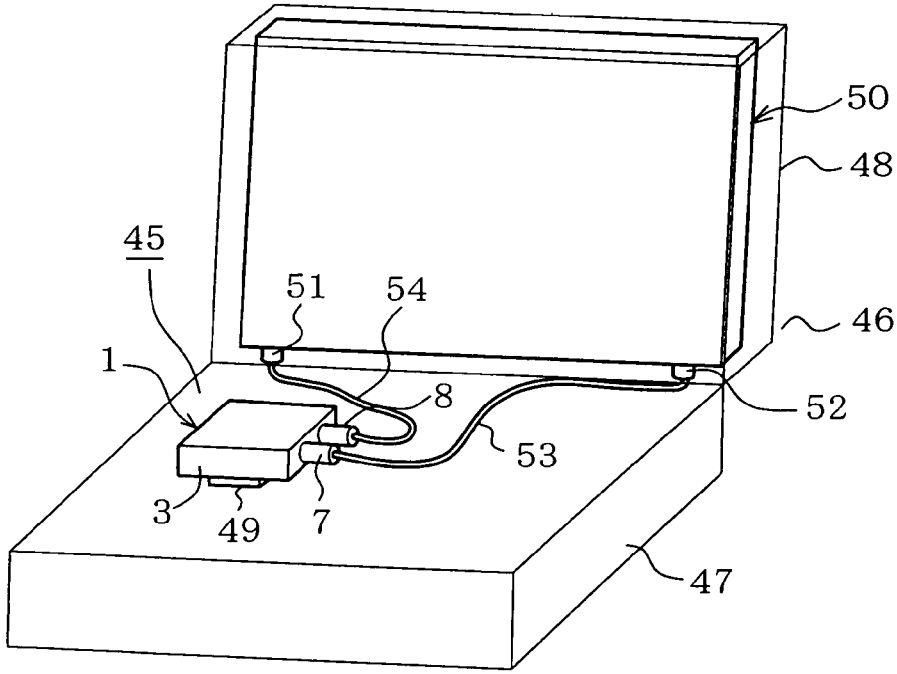
FIG. 9 is a schematic perspective view showing a personal computer in which the cooling apparatus is incorporated according to a second embodiment of the present invention.

Now, FIG. 9 depicts a second embodiment of the present invention, which is different from the first embodiment in the following aspect.

FIG. 9 is a schematic perspective view showing a laptop personal computer 46, which is an electrical appliance, and in which a cooling apparatus 45 including the fluid pump 1 is incorporated. The personal computer 46 includes a case 47, and a case cover 48 pivotally attached to the case 47 so as to open or close the case 47. The case 47 is provided with a keyboard (not shown) on the upper face thereof, and the case cover 48 includes an LCD (not shown) on the inner face thereof (the face opposing the upper face of the case 47).

The case 47 includes therein a CPU 49 which is a heat-generating component, disposed so as to contact the first case 3 of the fluid pump 1. The case cover 48 includes therein a heat-dissipating section 50, which includes a fluid path (not shown) that serves as a passage for a cooling liquid, and also an inlet 51 and outlet 52 communicating with the fluid path. The suction port 7 of the fluid pump 1 is connected to the outlet 52 via a connection tube 53, while the discharge port 8 of the fluid pump 1 is connected to the inlet 51 via a connection tube 54. A cooling liquid (fluid) is sealed in the pump chamber 6 of the fluid pump 1, as well as in the fluid path of the heat-dissipating section 45.

Under such a configuration, when the fluid pump 1 is activated, the liquid on the side of the heat-dissipating section 50 is sucked into the pump chamber 6 through the suction port 7, while the liquid inside the pump chamber 6 is discharged toward the connection tube 54 through the discharge port 8. The liquid discharged toward the connection tube 54 is sent to the fluid path of the heat-dissipating section 50.

During this process, the fluid flowing through the pump chamber 6 of the fluid pump 1 absorbs the heat generated by the CPU 49, thus to cool the CPU 49. The liquid that has removed the heat from the CPU 49 dissipates the heat at the heat-dissipating section 50, thus to be cooled. The cooled liquid is again sucked into the pump chamber 6 of the fluid pump 1, and removes the heat generated by the CPU 49. In this way, the liquid flowing through the fluid pump 1 prevents the CPU 49 from being overheated.

According to the second embodiment, employing the fluid pump 1 constructed so as to suppress vibration and noise for use with the cooling apparatus 45 incorporated in the personal computer 46 achieves the personal computer 46 that suppresses vibration or noise.

Figure 10:
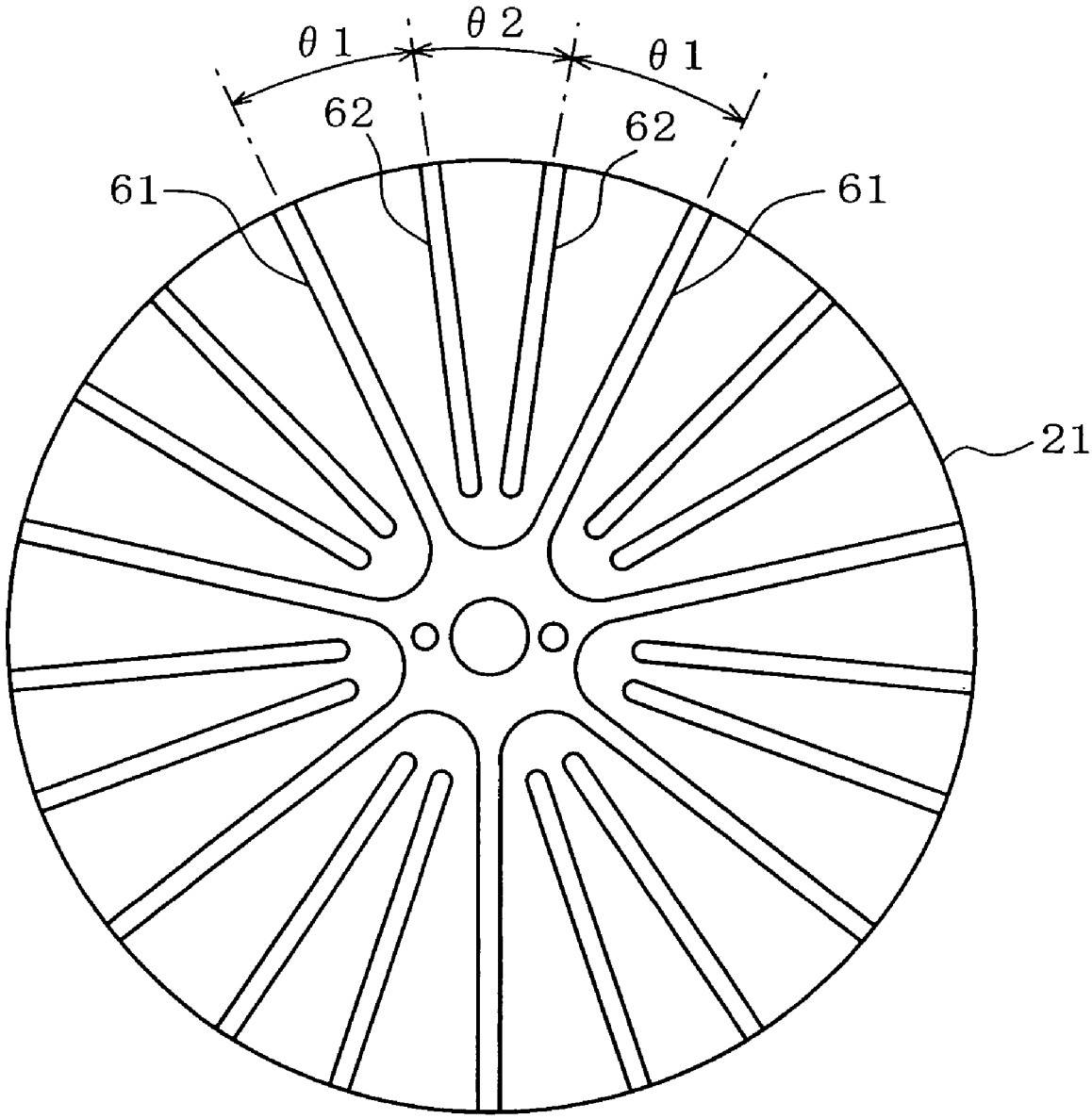
FIG. 10 is an elevational view showing an impeller according to a third embodiment of the present invention.
Figure 11:
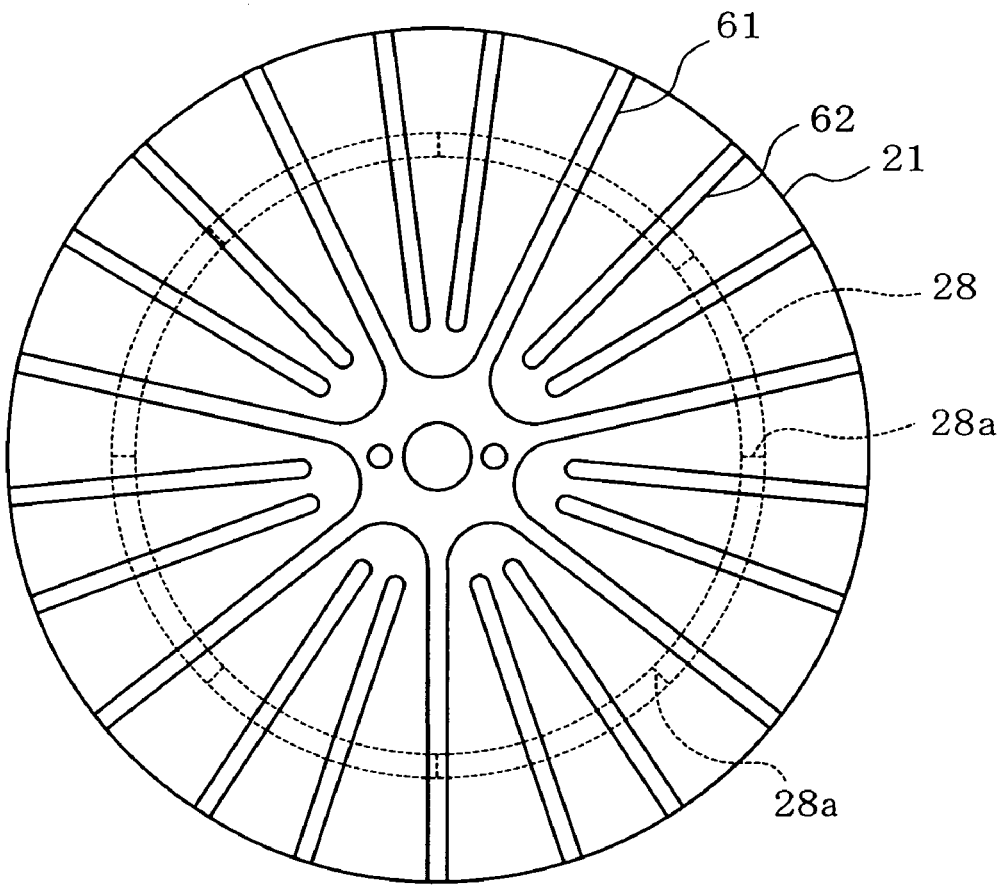
FIG. 11 is a schematic plan view showing a layout of pump vanes of the impeller and a magnetic pole boundary of a rotor magnet.

FIGS. 10 and 11 depict a third embodiment of the present invention, which is different from the first embodiment in the following aspect. Referring to FIG. 10, the impeller 21 includes first pump vanes 61 radially extending from a central portion thereof, and second pump vanes 62 radially extending from halfway, such that the total number of the first pump vanes 61 and the second pump vanes 62 becomes 21, which is an odd number.

More specifically, the first pump vanes 61 are arranged at 7 positions, between which two each of the second pump vanes 62 are arranged. An angle $\theta 1$ between a first pump vane 61 and an adjacent second pump vane 62, and an angle $\theta 2$ between two second pump vanes 62 arranged next to each other are different ($\theta 1 > \theta 2$). Accordingly, the interval between the pump vanes 61 and 62 is partially unequal.

Referring to FIG. 11, the rotor magnet 28 of the motor 15 coupled with the impeller 21 has 8 magnetic poles, and the rotor magnet 28 is mounted such that a pole boundary 28*a* is shifted as much as possible from the first and the second pump vanes 61 and 62.

The third embodiment provides the following advantageous effects. Since the total number of the first and the second pump vanes 61 and 62 of the impeller 21 is set to be 21, the impeller 21 generates a pressure 21 times per rotation. On the other hand as for the motor 15, since the rotor magnet 28 has 8 magnetic poles and the stator 16 has 12 slots, the rotor 26 generates a cogging torque 24 times per rotation, which is the lowest common multiple thereof. Therefore, the pressure generating frequency by rotation of the impeller 21 and the cogging torque generating frequency of the motor 15 are different, which allows reduction in the vibration and noise.

Also, the total number of the first and the second pump vanes 61 and 62 of the impeller 21 is set to be 21, which is an odd number. On the other hand, the motor 15 usually generates a cogging torque an even number of times per rotation of the rotor 26, for example, 24 times according to this embodiment, which is hence usually different from the number of pump vanes. Therefore, the impeller 21 generates a pressure at a different timing from the cogging torque generation, in addition to the difference between the pressure generating frequency and the cogging torque frequency. This allows further reduction the vibration and noise.

Further, since the first and the second pump vanes 61 and 62 of the impeller 21 are arranged at irregular intervals, the impeller 21 does not generate a pressure at a constant pitch. Accordingly, the pressure generating timing is shifted from the cogging torque generating timing. This also allows reducing the vibration and noise. Arranging thus the first and the second pump vanes 61 and 62 of the impeller 21 at irregular intervals also lowers a vibration frequency at the moment of the pressure generation by the rotation of the impeller 21, thereby reducing uncomfortable high-frequency component.

Figure 12:
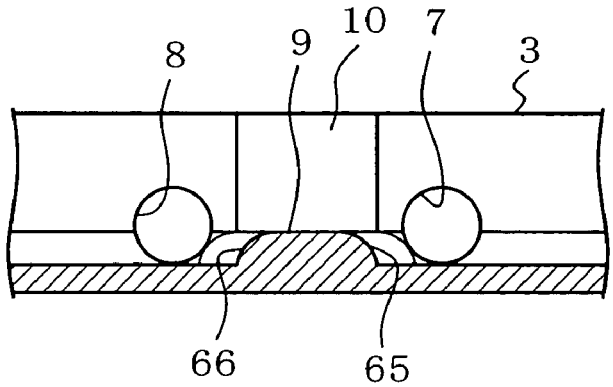
FIG. 12 is a similar view to FIG. 6, according to a fourth embodiment of the present invention.

FIG. 12 depicts a fourth embodiment of the present invention, which is different from the first embodiment in the following aspect. The lateral faces of the first pressure generating protrusion 9 are formed in smooth curved surfaces 65 and 66, instead of smooth flat slopes 11 and 12.

While the curved surfaces 65 and 66 present a convex curve (rounded corners) in FIG. 12, these surfaces may be formed in a concave curve.

The present invention is not limited to the foregoing embodiments, but various modifications or expansions may be made, for example, as follows.

The fluid to be circulated by the fluid pump 1 may be a gas, instead of a liquid.

The rotor 26 of the motor 15 for rotating the impeller 21 may be placed outside the pump chamber 6.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim:

1. A fluid pump comprising:

a case having a pump chamber defined by a bottom perpendicular to an axial direction and a circumferential surface parallel to the axial direction;

a suction port and a discharge port both provided in the circumferential surface so as to communicate with the pump chamber;

an impeller rotatably mounted in the pump chamber, the impeller, when rotated, sucking a fluid into the pump chamber via the suction port and discharging the fluid out of the pump chamber via the discharge port, the impeller having a disc-shaped portion having a flat region opposed to the bottom, the flat region being provided with a plurality of pump vanes protruding toward the bottom of the pump chamber, the pump vanes being arranged so as to extend radially from near a center of the flat surface near to a peripheral edge of the flat surface on the flat region;

a pressure generating protrusion provided on the bottom of the pump chamber to generate pressure based on rotation of the impeller, the pressure generating protrusion being shaped so as to axially protrude from the bottom of the pump chamber, the pressure generating protrusion being formed into a shape of a rib which extends radially so that one of two ends thereof is located between the suction and discharge ports and so that the other end thereof is located at a center of rotation of the impeller and which has a sectorial flat surface with a maximum circumferential width at said one end of the pressure generating protrusion and a minimum circumferential width at said other end of the pressure generating protrusion, whereupon the pressure generating protrusion is provided with a front side rising surface confronting a rotational direction of the impeller and a rear side rising surface opposed to the front rising surface, the front side rising surface being formed into a shape inclined in the rotational direction of the impeller; and a motor, which drives the impeller, installed in the case and having a stator and a rotor to which the impeller is attached for rotating together.

2. The fluid pump of claim 1, wherein a part or all of the pump vanes of the impeller are located at irregular intervals.

3. The fluid pump according to claim 1, wherein the number of pump vanes of the impeller is an odd number.

4. A fluid pump comprising:

a case having a pump chamber defined by a bottom perpendicular to an axial direction and a circumferential surface parallel to the axial direction;

a suction-port and a discharge port both provided in the circumferential surface so as to communicate with the pump chamber;

an impeller rotatably mounted in the pump chamber, the impeller, when rotated, sucking a fluid into the pump chamber via the suction port and discharging the fluid out of the pump chamber via the discharge port, the impeller having a disc-shaped portion having a flat region opposed to the bottom, the flat region being provided with a plurality of pump vanes protruding toward the bottom of the pump chamber, the pump vanes being arranged so as to extend radially from near a center of the flat surface near to a peripheral edge of the flat surface on the flat region;

a pressure generating protrusion provided on the bottom of the pump chamber to generate pressure based on rotation of the impeller, the pressure generating protrusion being shaped so as to axially protrude from the bottom of the pump chamber, the pressure generating protrusion being formed into a shape of a rib which extends radially so that one of two ends thereof is located between the suction and discharge ports and so that the other end thereof is located at a center of rotation of the impeller and which has a sectorial flat surface with a maximum circumferential width at said one end of the pressure generating protrusion and a minimum circumferential width at said other end of the pressure generating protrusion, whereupon the pressure generating protrusion is provided with a front side rising surface confronting a rotational direction of the impeller and a rear side rising surface opposed to the front rising surface; and a motor, which drives the impeller, installed in the case and having a stator with a plurality of slots and a rotor to which the impeller is attached for rotating together, wherein a center line of each slot of the motor and a radial line extending along the front side rising surface of the pressure generating protrusion are located away from each other circumferentially relative to the stator.

5. The fluid pump according to claim 4, wherein the number of pump vanes of the impeller is an odd number.

6. The fluid pump according to claim 4, wherein a part or all of the pump vanes of the impeller are located at irregular intervals.

7. A fluid pump comprising:

a case having a pump chamber defined by a bottom perpendicular to an axial direction and a circumferential surface parallel to the axial direction;

a suction port and a discharge port both provided in the circumferential face so as to communicate with the pump chamber;

an impeller rotatably mounted in the pump chamber, the impeller, when rotated, sucking a fluid into the pump chamber via the suction port and discharging the fluid out of the pump chamber via the discharge port, the impeller having a disc-shaped portion having a flat region opposed to the bottom, the flat region being provided with a plurality of pump vanes protruding toward the bottom of the pump chamber, the pump vanes being arranged so as to extend radially from near a center of the flat surface near to a peripheral edge of the flat surface on the flat region;

a pressure generating protrusion provided on the bottom of the pump chamber to generate pressure based on rotation of the impeller, the pressure generating protrusion being shaped so as to axially protrude from the bottom of the pump chamber, the pressure generating protrusion being formed into a shape of a rib which extends radially so that one of two ends thereof is located between the suction and discharge ports and so that the other end thereof is located at a center of rotation of the impeller and which has a sectorial flat surface with a maximum circumferential width at said one end of the pressure generating protrusion and a minimum circumferential width at said other end of the pressure generating protrusion, whereupon the pressure generating protrusion is provided with a front side rising surface confronting a rotational direction of the impeller and a rear side rising surface opposed to the front rising surface; and a motor, which drives the impeller, installed in the case and having a stator with a plurality of slots and a rotor to which the impeller is attached for rotating together, wherein the number of the pump vanes of the impeller is set so that a frequency of a cogging torque resulting from the number of magnetic poles of the rotor and the number of the slots of the stator differs from a pressure generating frequency generated according to the number of the pump vanes of the impeller in the pressure generating protrusion.

8. The fluid pump according to claim 7, wherein the number of pump vanes of the impeller is an odd number.

9. The fluid pump according to claim 7, wherein a part or all of the pump vanes of the impeller are located at irregular intervals.

10. A cooling apparatus, comprising:

a fluid pump that circulates a cooling fluid, the fluid pump comprising a case having a pump chamber defined by a bottom perpendicular to an axial direction and a circumferential surface parallel to the axial direction;

a suction port and a discharge port both provided in the circumferential surface so as to communicate with the pump chamber;

an impeller rotatably mounted in the pump chamber, the impeller, when rotated, sucking a fluid into the pump chamber via the suction port and discharging the fluid out of the pump chamber via the discharge port, the impeller having a disc-shaped portion having a flat region opposed to the bottom, the flat region being provided with a plurality of pump vanes protruding toward the bottom of the pump chamber, the pump vanes being arranged so as to extend radially from near a center of the flat surface near to a peripheral edge of the flat surface on the flat region;

a pressure generating protrusion provided on the bottom of the pump chamber to generate pressure based on rotation of the impeller, the pressure generating protrusion being shaped so as to axially protrude from the bottom of the pump chamber, the pressure generating protrusion being formed into a shape of a rib which extends radially so that one of two ends thereof is located between the suction and discharge ports and so that the other end thereof is located at a center of rotation of the impeller and which has a sectorial flat surface with a maximum circumferential width at said one end of the pressure generating protrusion and a minimum circumferential width at said other end of the pressure generating protrusion, whereupon the pressure generating protrusion is provided with a front side rising surface confronting a rotational direction of the impeller and a rear side rising surface opposed to the front rising surface, the front side rising surface being formed into a shape inclined in the rotational direction of the impeller; and a motor, that drives the impeller, installed in the case and having a stator and a rotor to which the impeller is attached for rotating together.

11. The fluid pump of claim 10, wherein a part or all of the pump vanes of the impeller are located at irregular intervals.

12. A cooling apparatus, comprising:

a fluid pump that circulates a cooling fluid, the fluid pump comprising a case having a pump chamber defined by a bottom perpendicular to an axial direction and a circumferential surface parallel to the axial direction;

a suction port and a discharge port both provided in the circumferential surface so as to communicate with the pump chamber;

an impeller rotatably mounted in the pump chamber, the impeller, when rotated, sucking a fluid into the pump chamber via the suction port and discharging the fluid out of the pump chamber via the discharge port, the impeller having a disc-shaped portion having a flat region opposed to the bottom, the flat region being provided with a plurality of pump vanes protruding toward the bottom of the pump chamber, the pump vanes being arranged so as to extend radially from near a center of the flat surface near to a peripheral edge of the flat surface on the flat region;

a pressure generating protrusion provided on the bottom of the pump chamber to generate pressure based on rotation of the impeller, the pressure generating protrusion being shaped so as to axially protrude from the bottom of the pump chamber, the pressure generating protrusion being formed into a shape of a rib which extends radially so that one of two ends thereof is located between the suction and discharge ports and so that the other end thereof is located at a center of rotation of the impeller and which has a sectorial flat surface with a maximum circumferential width at said one end of the pressure generating protrusion and a minimum circumferential width at said other end of the pressure generating protrusion, whereupon the pressure generating protrusion is provided with a front side rising surface confronting a rotational direction of the impeller and a rear side rising surface opposed to the front rising surface; and a motor for driving the impeller, installed in the case and having a stator having a plurality of slots and a rotor to which the impeller is attached for rotating together, wherein a center line of each slot of the motor and a radial line extending along the front side rising surface of the pressure generating protrusion are located away from each other circumferentially relative to the stator.

13. The fluid pump according to claim 12, wherein a part or all of the pump vanes of the impeller are located at irregular intervals.

14. A cooling apparatus, comprising:

a fluid pump that circulates a cooling fluid, the fluid pump comprising a case having a pump chamber defined by a bottom perpendicular to an axial direction and a circumferential surface parallel to the axial direction;

a suction port and a discharge port both provided in the circumferential face so as to communicate with the pump chamber;

an impeller rotatably mounted in the pump chamber, the impeller, when rotated, sucking a fluid into the pump chamber via the suction port and discharging the fluid out of the pump chamber via the discharge port, the impeller having a disc-shaped portion having a flat region opposed to the bottom, the flat region being provided with a plurality of pump vanes protruding toward the bottom of the pump chamber, the pump vanes being arranged so as to extend radially from near a center of the flat surface near to a peripheral edge of the flat surface on the flat region;

a pressure generating protrusion provided on the bottom of the pump chamber to generate pressure based on rotation of the impeller, the pressure generating protrusion being shaped so as to axially protrude from the bottom of the pump chamber, the pressure generating protrusion being formed into a shape of a rib which extends radially so that one of two ends thereof is located between the suction and discharge ports and so that the other end thereof is located at a center of rotation of the impeller and which has a sectorial flat surface with a maximum circumferential width at said one end of the pressure generating protrusion and a minimum circumferential width at said other end of the pressure generating protrusion, whereupon the pressure generating protrusion is provided with a front side rising surface confronting a rotational direction of the impeller and a rear side rising surface opposed to the front rising surface; and a motor, which drives the impeller, installed in the case and having a stator and a rotor to which the impeller is attached for rotating together, wherein the number of pump vanes of the impeller is set so that a frequency of a cogging torque resulting from the number of magnetic poles of the rotor and the number of the slots of the stator differs from a pressure generating frequency generated according to the number of the pump vanes of the impeller in the pressure generating protrusion.

15. The fluid pump according to claim 14, wherein a part or all of the pump vanes of the impeller are located at irregular intervals.

16. An electrical appliance, comprising:

a cooling apparatus that includes a fluid pump that circulates a cooling fluid through the cooling apparatus, the fluid pump comprising a case having a pump chamber defined by a bottom perpendicular to an axial direction and a circumferential surface parallel to the axial direction;

a suction port and a discharge port both provided in the circumferential surface so as to communicate with the pump chamber;

an impeller rotatably mounted in the pump chamber, the impeller, when rotated, sucking a fluid into the pump chamber via the suction port and discharging the fluid out of the pump chamber via the discharge port, the impeller having a disc-shaped portion having a flat region opposed to the bottom, the flat region being provided with a plurality of pump vanes protruding toward the bottom of the pump chamber, the pump vanes being arranged so as to extend radially from near a center of the flat surface near to a peripheral edge of the flat surface on the flat region;

a pressure generating protrusion provided on the bottom of the pump chamber to generate pressure based on rotation of the impeller, the pressure generating protrusion being shaped so as to axially protrude from the bottom of the pump chamber, the pressure generating protrusion being formed into a shape of a rib which extends radially so that one of two ends thereof is located between the suction and discharge ports and so that the other end thereof is located at a center of rotation of the impeller and which has a sectorial flat surface with a maximum circumferential width at said one end of the pressure generating protrusion and a minimum circumferential width at said other end of the pressure generating protrusion, whereupon the pressure generating protrusion is provided with a front side rising surface confronting a rotational direction of the impeller and a rear side rising surface opposed to the front rising surface, the front side rising surface being formed into a shape inclined in the rotational direction of the impeller; and a motor for driving the impeller, installed in the case and having a stator and a rotor to which the impeller is attached for rotating together.

17. The electrical appliance of claim 16, wherein a part or all of the pump vanes of the impeller are located at irregular intervals.

18. An electrical appliance, comprising:

a cooling apparatus that includes a fluid pump that circulates a cooling fluid through the cooling apparatus, the fluid pump comprising a case having a pump chamber defined by a bottom perpendicular to an axial direction and a circumferential surface parallel to the axial direction;

a suction port and a discharge port both provided in the circumferential surface so as to communicate with the pump chamber;

an impeller rotatably mounted in the pump chamber, the impeller, when rotated, sucking a fluid into the pump chamber via the suction port and discharging the fluid out of the pump chamber via the discharge port, the impeller having a disc-shaped portion having a flat region opposed to the bottom, the flat region being provided with a plurality of pump vanes protruding toward the bottom of the pump chamber, the pump vanes being arranged so as to extend radially from near a center of the flat surface near to a peripheral edge of the flat surface on the flat region;

a pressure generating protrusion provided on the bottom of the pump chamber to generate pressure based on rotation of the impeller, the pressure generating protrusion being shaped so as to axially protrude from the bottom of the pump chamber, the pressure generating protrusion being formed into a shape of a rib which extends radially so that one of two ends thereof is located between the suction and discharge ports and so that the other end thereof is located at a center of rotation of the impeller and which has a sectorial flat surface with a maximum circumferential width at said one end of the pressure generating protrusion and a minimum circumferential width at said other end of the pressure generating protrusion, whereupon the pressure generating protrusion is provided with a front side rising surface confronting a rotational direction of the impeller and a rear side rising surface opposed to the front rising surface; and a motor, which drives the impeller, installed in the case and having a stator with a plurality of slots and a rotor to which the impeller is attached for rotating together, wherein a center line of each slot of the motor and a radial line extending along the front side rising surface of the pressure generating protrusion are located from each other circumferentially relative to the stator.

19. The fluid pump according to claim 18, wherein a part or all of the pump vanes of the impeller are located at irregular intervals.

20. An electrical appliance, comprising: a cooling apparatus that includes a fluid pump that circulates a cooling fluid through the cooling apparatus, the fluid pump comprising a case having a pump chamber defined by a bottom perpendicular to an axial direction and a circumferential surface parallel to the axial direction;

a suction port and a discharge port both provided in the circumferential face so as to communicate with the pump chamber;

an impeller rotatably mounted in the pump chamber, the impeller, when rotated, sucking a fluid into the pump chamber via the suction port and discharging the fluid out of the pump chamber via the discharge port, the impeller having a disc-shaped portion having a flat region opposed to the bottom, the flat region being provided with a plurality of pump vanes protruding toward the bottom of the pump chamber, the pump vanes being arranged so as to extend radially from near a center of the flat surface near to a peripheral edge of the flat surface on the flat region;

a pressure generating protrusion provided on the bottom of the pump chamber to generate pressure based on rotation of the impeller, the pressure generating protrusion being shaped so as to axially protrude from the bottom of the pump chamber, the pressure generating; protrusion being formed into a shape of a rib which extends radially so that one of two ends thereof is located between the suction and discharge ports and so that the other end thereof is located at a center of rotation of the impeller and which has a sectorial flat surface with a maximum circumferential width at said one end of the pressure generating protrusion and a minimum circumferential width at said other end of the pressure generating protrusion, whereupon the pressure generating; protrusion is provided with a front side rising surface confronting a rotational direction of the impeller and a rear side rising surface opposed to the front side rising surface;

a motor, which drives the impeller, installed in the case and having a stator and a rotor to which the impeller is attached for rotating together, wherein the number of the pump vanes of the impeller is set so that a frequency of a cogging torque resulting from the number of magnetic poles of the rotor and the number of the slots of the stator differs from a pressure generating frequency generated according to the number of the pump vanes of the impeller in the pressure generating protrusion.

21. The fluid pump according to claim 20, wherein a part or all of the pump vanes of the impeller are located at irregular intervals.

* * * * *